US006347402B1

(12) United States Patent
Aoki

(10) Patent No.: US 6,347,402 B1
(45) Date of Patent: Feb. 19, 2002

(54) BALL CATCHING TOOL

(75) Inventor: Akio Aoki, Hirakata (JP)

(73) Assignee: Trion Corporation, Osaka (JP)

( * ) Notice: Subject to any disclaimer, the term of this patent is extended or adjusted under 35 U.S.C. 154(b) by 0 days.

(21) Appl. No.: 09/765,489

(22) Filed: Jan. 18, 2001

(30) Foreign Application Priority Data

Nov. 20, 2000 (JP) ..... 2000-352099

(51) Int. Cl.[7] ..... A41D 13/08
(52) U.S. Cl. ..... 2/19
(58) Field of Search ..... 2/16, 19, 159, 2/160, 161.1, 161.3, 161.5, 161.6, 162, 161.4

(56) References Cited

U.S. PATENT DOCUMENTS 4,065,813 A * 1/1978 Hudson ..... 2/19
4,541,127 A * 9/1985 Gould ..... 2/19
4,651,345 A * 3/1987 Latina ..... 2/19
4,853,975 A * 8/1989 Clevenhagen ..... 2/19
4,891,845 A * 1/1990 Hayes ..... 2/19
4,896,376 A * 1/1990 Miner ..... 2/19
4,937,882 A * 7/1990 Hayes ..... 2/19
5,031,238 A * 7/1991 Hayes ..... 2/19
5,031,239 A 7/1991 Panichello et al. ..... 2/19
5,214,798 A * 6/1993 McLaughlin ..... 2/19
5,457,819 A * 10/1995 Aoki ..... 2/19
5,575,005 A * 11/1996 Walker et al. ..... 2/19
5,671,477 A * 9/1997 Aoki ..... 2/19
5,694,641 A * 12/1997 Doi et al. ..... 2/19
5,717,995 A * 2/1998 Murai ..... 2/19
5,850,633 A * 12/1998 Lovin ..... 2/19
5,867,830 A * 2/1999 Chen ..... 2/161.1
5,991,917 A * 11/1999 Kaake ..... 2/19

* cited by examiner

*Primary Examiner*—John J. Calvert
*Assistant Examiner*—Gary L. Welch
(74) *Attorney, Agent, or Firm*—Fulbright & Jaworski L.L.P.

(57) ABSTRACT

A ball catching tool comprising a ball catching tool body provided with a band in a direction of a hand width for receiving and supporting a back of a hand, the band being capable-of being fastened and unfastened from the hand, wherein the band has such a structure that one of both ends opposite to a thumb bag portion side of the ball catching tool body is connected to an outer cover on a back face side of the ball catching tool body through flexible means and can prevent constriction force of the band from acting on the outer cover to be curved and deformed with a ball catching operation.

8 Claims, 7 Drawing Sheets

BALL CATCHING TOOL

BACKGROUND OF INVENTION

1. Field of the Invention

The present invention relates to a ball catching tool and more particularly to a glove or a mitt to be used for ball games such as baseball.

2. Description of the Related Art

Examples of a ball catching tool include an opening type catching tool comprising a ball catching tool body provided with a band for receiving and supporting the back of a hand in a direction of a hand width and an enclosing type ball catching tool provided with an outer cover to cover the back of the hand.

As described above, the opening type ball catching tool comprises a band capable of being fastened to or unfastened from the hand. The enclosing type ball catching tool has such a structure that a cover portion on the hand insertion side for receiving and supporting the wrist side of the back of the hand can be fastened to or unfastened from the hand. During ball catching, it is possible to prevent the ball catching tool from slipping off from the hand or being shifted from the hand, resulting in easiness of catching.

Conventionally, the band of the opening type ball catching tool has been fixed to the back face portion of the ball catching tool body. The cover portion on the hand insertion side of the enclosing type ball catching tool is formed continuously to a main cover portion on the finger side.

In order to obtain reliable catching through the ball catching tool, each finger should be tightly bent to catch a ball such that an inner cover corresponding to the hand palm side of the ball catching tool encloses a ball. In particular, when the ball rotates irregularly, the above-mentioned ball catching operation is required.

However, the conventional opening type ball catching tool has such a structure that the band is fixed to the back face portion of the ball catching tool body and the band can freely be fastened to the hand. The conventional enclosing type ball catching tool has such a structure that the outer cover portion on the hand insertion side is formed consecutively to the main outer cover portion on the finger side and the outer cover portion on the hand insertion side is freely fastened to the hand. For this reason, the following problem arises.

More specifically, the band fastened to the hand (the outer cover portion on the hand insertion side of the enclosing type ball catching tool and so is the following) in an attachment state is shifted with difficulty in the longitudinal direction of the hand with respect to the hand by fastening force.

When each finger is to be bent in this state for catching a ball, tensile force preventing the outer cover from being curved and deformed with the ball catching operation acts on the outer cover from the band (the outer cover portion on the hand insertion side) so that the outer cover is brought into a constraint state.

As a result, the outer cover is curved and deformed with difficulty so that it is hard to catch a ball with each finger tightly bent.

There has been proposed a structure in which an end of a band on the little finger bag side of a ball catching tool body is connected to an outer cover through an elastic member. Such a structure cannot solve the above-mentioned problem.

SUMMARY OF THE INVENTION

In consideration of the above-mentioned problem of the prior art, it is an object of the present invention to provide a ball catching tool in which a band provided in a direction of a hand width for receiving and supporting the back of a hand or an outer cover portion on the hand insertion side for receiving and supporting the wrist side of the back of the hand can be freely fastened and unfastened, and furthermore, a ball can be caught more easily.

The object can be achieved by the invention described in claims.

More specifically, the present invention provides a ball catching tool comprising a ball catching tool body provided with a band in a direction of a hand width for receiving and supporting a back of a hand, the band being capable of being fastened and unfastened from the hand, wherein the band has such a structure that one of both ends opposite to a thumb bag portion side of the ball catching tool body is connected to an outer cover on a back face side of the ball catching tool body through flexible means and can prevent constriction force of the band from acting on the outer cover to be curved and deformed with a ball catching operation.

According to this structure, the following functions are obtained.

[a] A hand is inserted into the ball catching tool body through the hand insertion port and the band is fastened and attached to the hand. Consequently, it is possible to prevent the ball catching tool from slipping off from the hand or being shifted from the hand during ball catching.

[b] In the state in which the ball catching tool is attached to the hand as in the [a], the band fastened to the hand is shifted with difficulty from the hand in the longitudinal direction of the hand by fastening force. According to the structure of the present invention, however, one of both ends opposite to a thumb bag portion side of the ball catching tool body is connected to an outer cover through flexible means and can prevent constriction force of the band from acting on the outer cover to be curved and deformed with a ball catching operation. Therefore, when each finger is bent during ball catching, the outer cover is separated from the band which is hard to shift from the hand and is easily curved and deformed.

[c] By the functions [a] and [b], each finger can be tightly bent to catch a ball such that the inner cover corresponding to the palm side of the hand of the ball catching tool body encloses the ball.

Accordingly, it is possible to provide a ball catching tool capable of fastening and unfastening the band provided in the direction of the hand width for receiving and supporting the back of the hand, and furthermore, capable of catching a ball still more.

It is preferable that the flexible means should form a predetermined number of through holes on one of sides of a connected portion of the outer cover or a connecting portion of the band and a predetermined number of band-shaped portions capable of individually inserting a loop for connection into the through holes and turning up the loop on the other side.

According to this structure, when each finger is bent for catching a ball, a predetermined portion of the outer cover or a predetermined portion of the connecting portion of the band is shifted in the longitudinal direction of the hand in the loop formed with the band-shaped portion on the connecting portion side of the band or the connected portion side of the outer cover, and the outer cover is separated from the band which is hard to shift from the hand in the longitudinal direction of the hand by fastening force and is easily curved and deformed together with the inner cover, which is much more convenient.

Furthermore, the present invention provides a ball catching tool comprising a ball catching body having such a structure that an outer cover on a back face side is formed to cover a back of a hand and a hand insertion port side outer cover portion for receiving and supporting a wrist side of the back of the hand can be fastened to and unfastened from the hand, wherein the hand insertion port outer cover portion is connected to a main outer cover portion on a finger side through flexible means and can prevent constriction force of the hand insertion port side outer cover portion from acting on the main outer cover portion to be curved and deformed with a ball catching operation.

According to this structure,

[d] the hand is inserted into the ball catching tool body through the hand insertion port and the band is fastened and attached to the hand. Consequently, it is possible to prevent the ball catching tool from slipping off from the hand or being shifted from the hand during ball catching.

[e] In the state in which the ball catching tool is attached to the hand as in the [d], the hand insertion port side outer cover portion fastened to the hand is shifted with difficulty from the hand in the longitudinal direction of the hand by fastening force. According to the above-mentioned structure, however, the hand insertion port side outer cover portion is connected to the main outer cover portion on the finger side through flexible means and can prevent constriction force of the hand insertion port side outer cover portion from acting on the main outer cover portion to be curved and deformed with a ball catching operation. Therefore, when each finger is bent during ball catching, the outer cover is separated from the hand insertion port side outer cover portion which is hard to shift from the hand and is easily curved and deformed.

[f] By the functions [d] and [e], each finger can be tightly bent to catch a ball such that the inner cover corresponding to the palm side of the hand of the ball catching tool body encloses the ball.

Accordingly, it is possible to provide a ball catching tool capable of fastening and unfastening the hand insertion port side outer cover portion for receiving and supporting the wrist side of the back of the hand, and furthermore, capable of catching a ball still more.

It is preferable that the flexible means should form a predetermined number of through holes on one of sides of a connected portion of the main outer cover portion or a connecting portion of the hand insertion port side outer cover portion and a predetermined number of band-shaped portions capable of individually inserting a loop for connection into the through holes and turning up the loop on the other side.

According to this structure, when each finger is bent for catching a ball, a predetermined portion of the hand insertion port side outer cover portion or a predetermined portion of the main outer cover portion is shifted in the longitudinal direction of the hand in the loop formed with the band-shaped portion on the connected portion side of the main outer cover portion or the connecting portion side of the hand insertion port side outer cover portion, and the main outer cover portion is separated from the hand insertion port side outer cover portion which is hard to shift from the hand in the longitudinal direction of the hand by fastening force is separated and is easily curved and deformed together with the inner cover.

Therefore, it is possible to provide a ball catching tool capable of catching a ball more easily.

It is preferable that the outer cover should be formed in such a state that the connected portion of the main outer cover portion and a connecting portion of the hand insertion port outer cover portion are provided apart from each other by a predetermined length, the connected portion of the main outer cover portion and the connecting portion of the hand insertion port side outer cover portion should be connected to each other through a connecting member, the flexible means should form a predetermined number of through holes on one of sides of the connected portion of the main outer cover portion or the connecting portion of the connecting member and on one of sides of the connected portion of the hand insertion port side outer cover portion and the connecting portion of the connecting member, and a predetermined number of band-shaped portions capable of individually inserting a loop for connection into the through holes and turning up the loop on the other side.

According to this structure, when each finger is bent for catching a ball, a predetermined portion on the connecting portion side of the connecting member or a predetermined portion on the connected portion side of the main outer cover portion is shifted in the longitudinal direction of the hand in the loop formed with the band-shaped portion on the connected portion side of the main outer cover portion or the connecting portion side of the connecting member, and a predetermined portion on the connecting portion side of the connecting member or a predetermined portion on the hand insertion port side outer cover portion is shift ed in the longitudinal direction of the hand in the loop formed with the band-shaped portion on the connected portion side of the hand insertion port side outer cover portion or the connecting portion side of the connecting member.

Consequently, the main outer cover portion is separated from the hand insertion port side outer cover portion which is hard to shift from the hand in the longitudinal direction of the hand by fastening force is separated and is easily curved and deformed together with the inner cover.

Accordingly, the present invention can provide a ball catching tool capable of catch a ball much more easily.

These objects as well as other objects, features and advantages of the present invention will become more apparent to those skilled in the art from the following description with reference to the accompanying drawings.

DETAILED DESCRIPTION OF THE PREFERRED EMBODIMENTS

Preferred embodiments of the present invention will be described in detail with reference to the drawings.

[THE FIRST EMBODIMENT]

Figure 1:
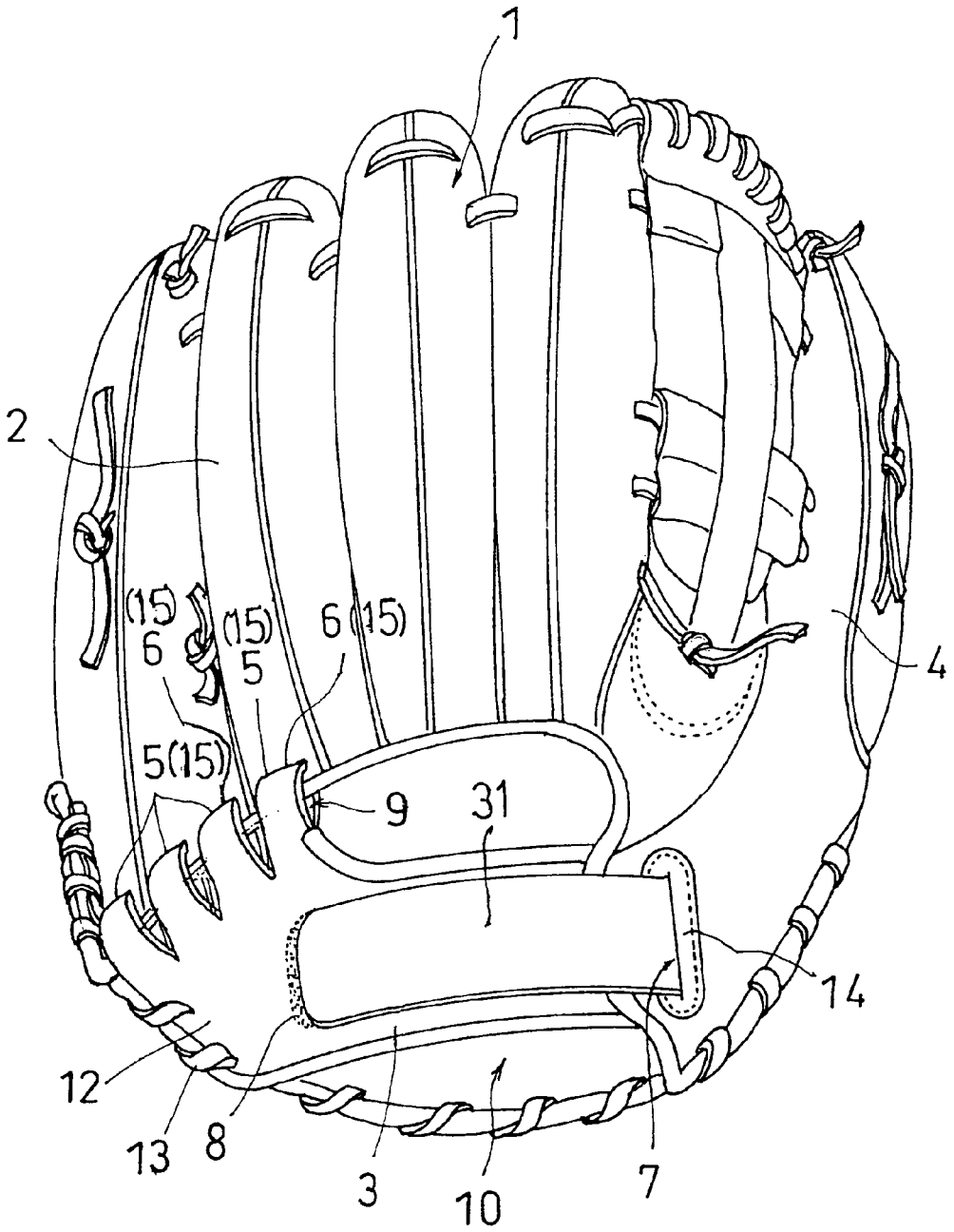
FIG. 1 is a rear view showing a ball catching tool according to a first embodiment.
Figure 2:
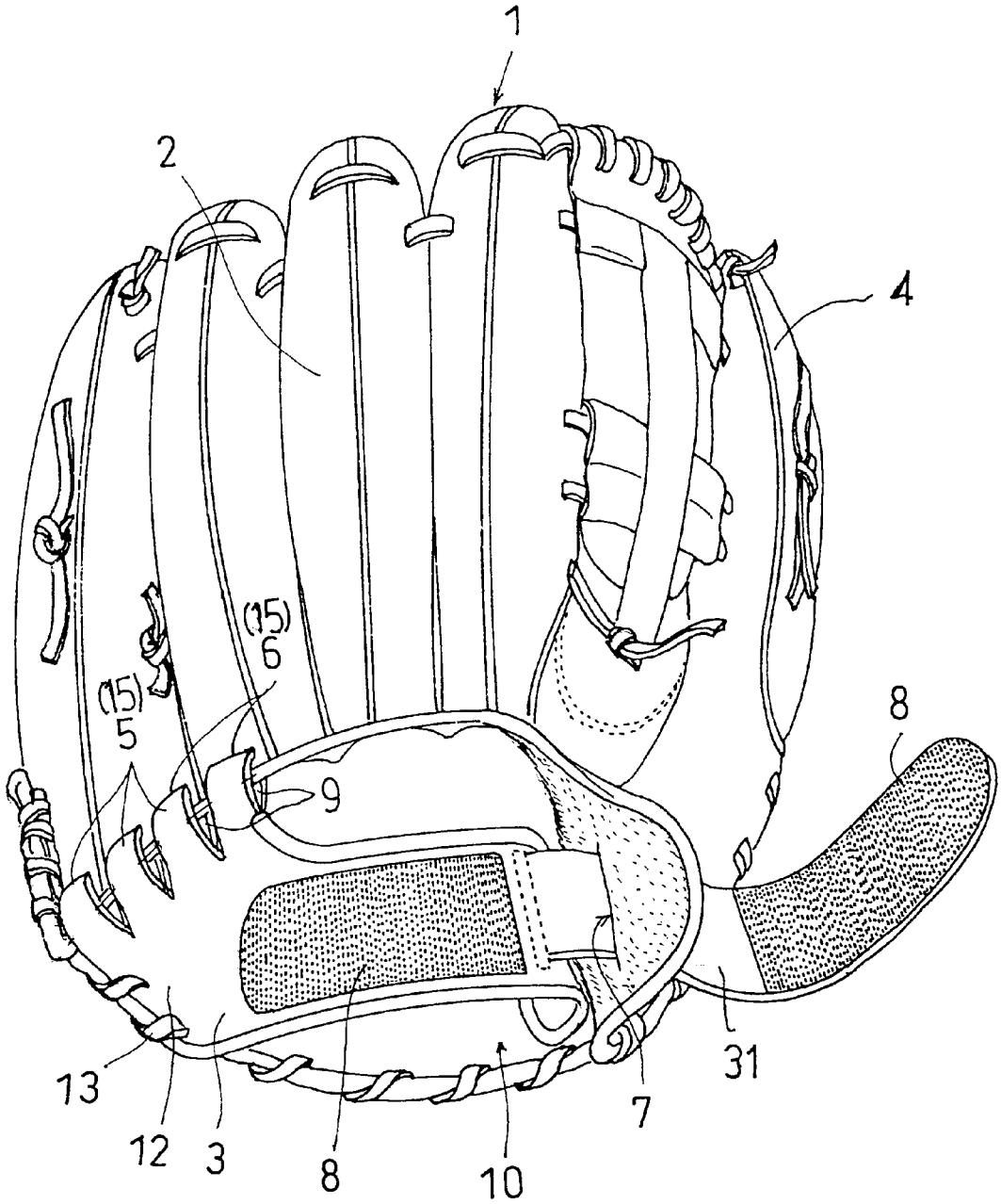
FIG. 2 is a view showing such a structure that a band of the ball catching tool in FIG. 1 can be freely fastened and unfastened.
Figure 3:
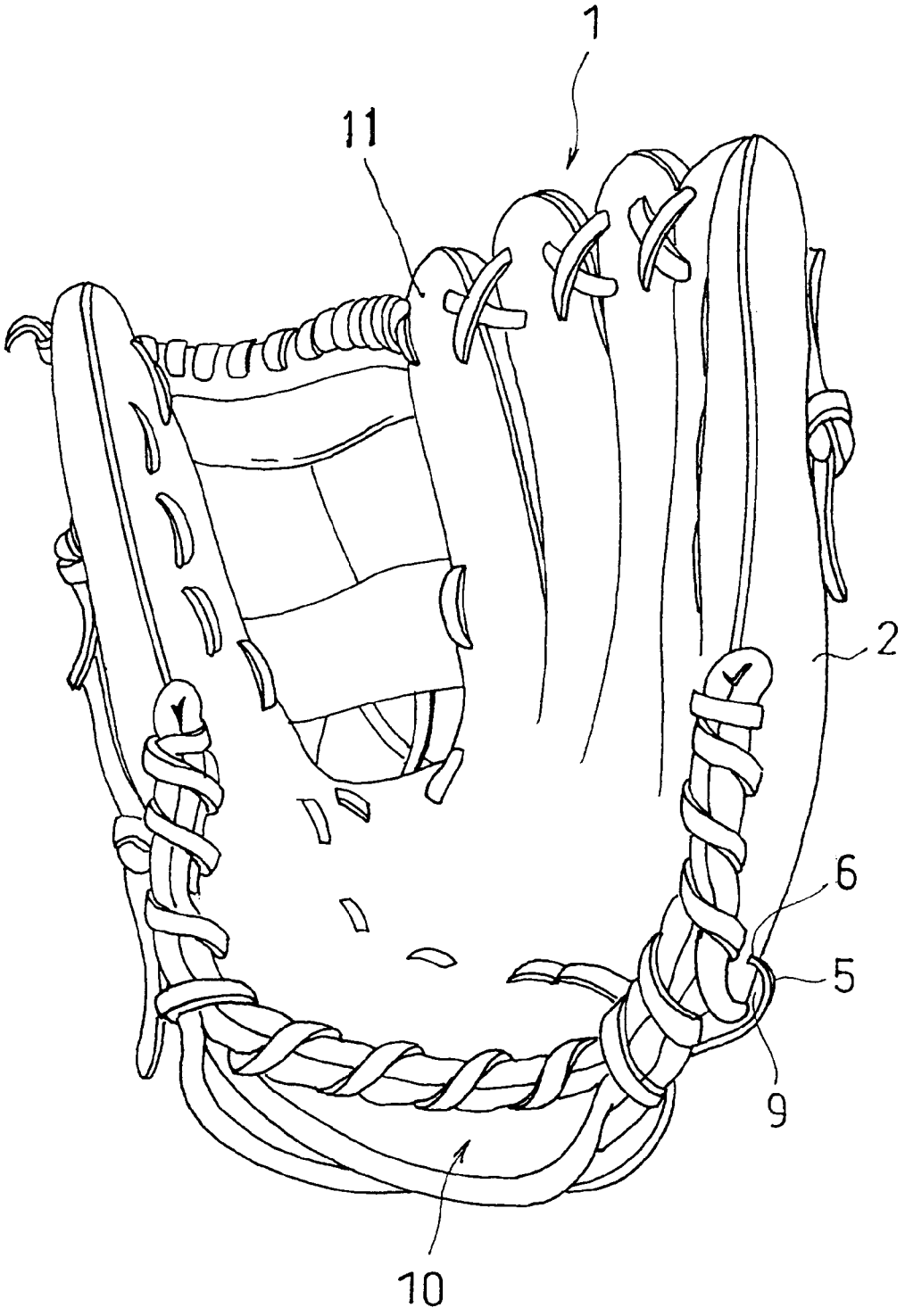
FIG. 3 is a perspective view showing the inner cover side of the ball catching tool in FIG. 1.

FIG. 1 to FIG. 3 show an opening type glove for a baseball which acts as a ball catching tool. The glove has such a structure that a band 3 for receiving and supporting the back of a hand in a direction of a hand width is provided in a back face portion of a glove body 1 (equivalent to a ball catching tool body) on the side corresponding to the back of the hand.

The band 3 is constituted to be freely fastened and unfastened. One of ends of the band 3 on the opposite side of the thumb bag portion 4 side of the glove body 1 is connected to an outer cover 2 on the back face side of the glove body 1 through flexible means 15. It is possible to prevent constriction force of the band 3 from acting on the outer cover 2 to be curved and deformed with the ball catching operation.

The flexible means 15 is provided with a plurality of through holes 6 formed in a portion connected to the outer cover 2, and is provided with a plurality of band-shaped portions 5 capable of being inserted in each of the through holes 6 and of turning up a loop 9 for connection in a connecting portion of the band 3.

More specifically, the band-shaped portions 5 are individually inserted in the through holes 6 of the outer cover 2. The tip side of each band-shaped portion 5 is turned up and fixed to the back face side. A predetermined portion of the portion connected to the outer cover 2 gently enters the loop 9 formed by the band-shaped portion 5. One side portion 12 of the band 3 on the outside of the band-shaped portion 5 in the direction of the hand width is connected to the inner cover 11 side through a strap 13.

As shown in FIG. 2, the band 3 can be freely fastened and unfastened in the following manner. An end of the band 3 on the thumb bag portion 4 side is separated from the glove body 1, and a through hole 7 for inserting a band member 31 provided on the band 3 is formed on the base end side of the thumb bag portion 4 to insert the band member 31 therethrough. In addition, a hook and loop faster 8 for bending, putting and connecting the band member 31 is provided on the band 3 and the band member 31.

In FIG. 1, the reference numeral 14 denotes a resin plate for reinforcement to be a reinforcing member for preventing the through hole 7 from being deformed. The resin plate 14 is sewn into the base end side of the thumb bag portion 4.

In the case in which the glove having the above-mentioned structure is to be attached, a hand is inserted from a hand insertion port 10 to the glove body 1 and the band 3 is fastened and attached to the hand. Consequently, it is possible to prevent the glove from slipping off or shifted from the hand during ball catching.

When each finger is bent during the ball catching, the predetermined portion of the outer cover 2 is shifted in the longitudinal direction of the hand in the loop 9 formed by the band-shaped portion 5 on the connecting portion side of the band 3 and the outer cover 2 is removed from the band 3 which is hard to shift in the longitudinal direction of the hand by the fastening force to the hand and is freely curved with the inner cover 11.

Figure 4:
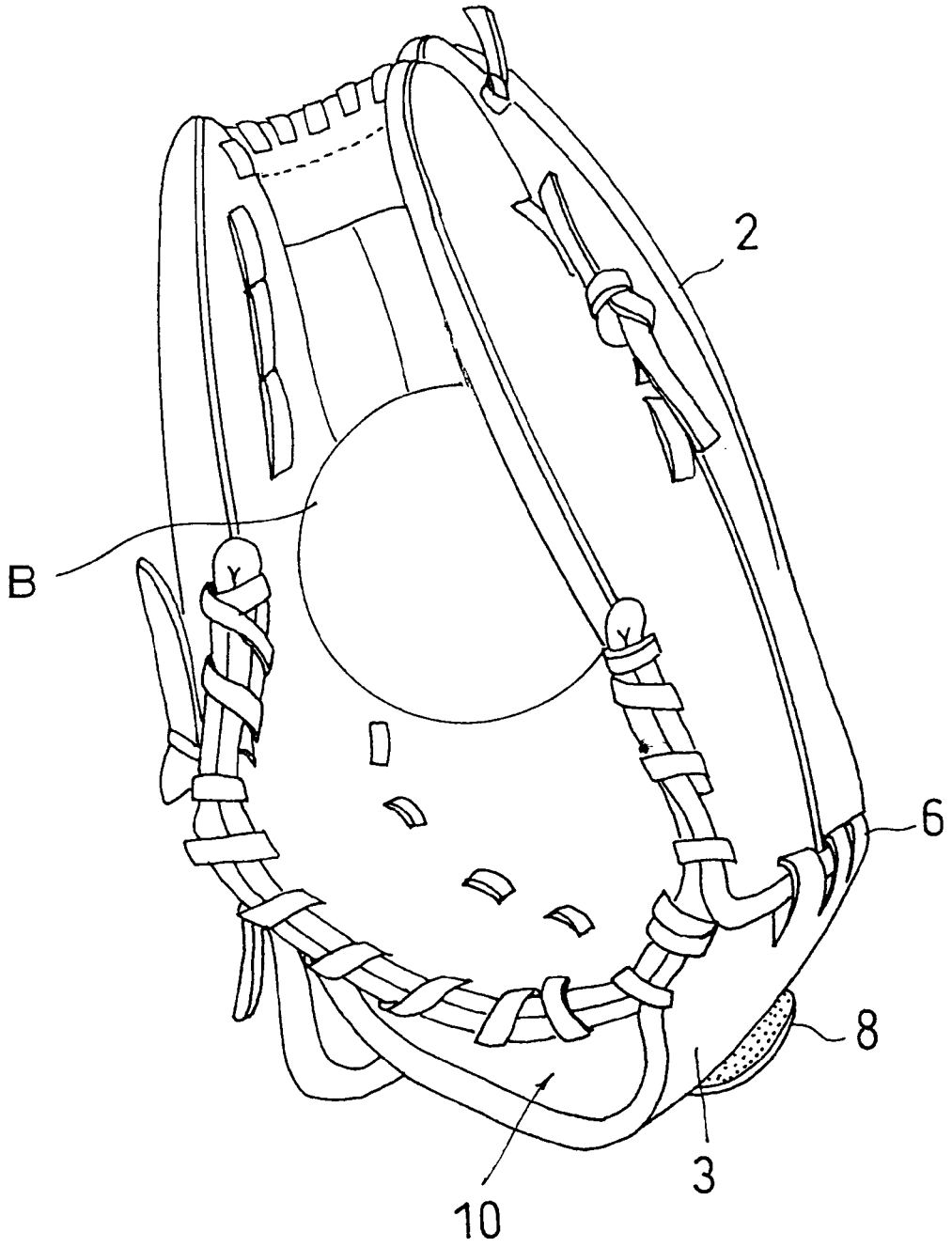
FIG. 4 is a perspective view showing a ball catching state of the ball catching tool in FIG. 1.

As a result, the inner cover 11 corresponding to the hand palm side of the glove body 1 can tightly bend each finger to catch a ball so as to enclose a ball B (see FIG. 4).

[THE SECOND EMBODIMENT]

Figure 5:
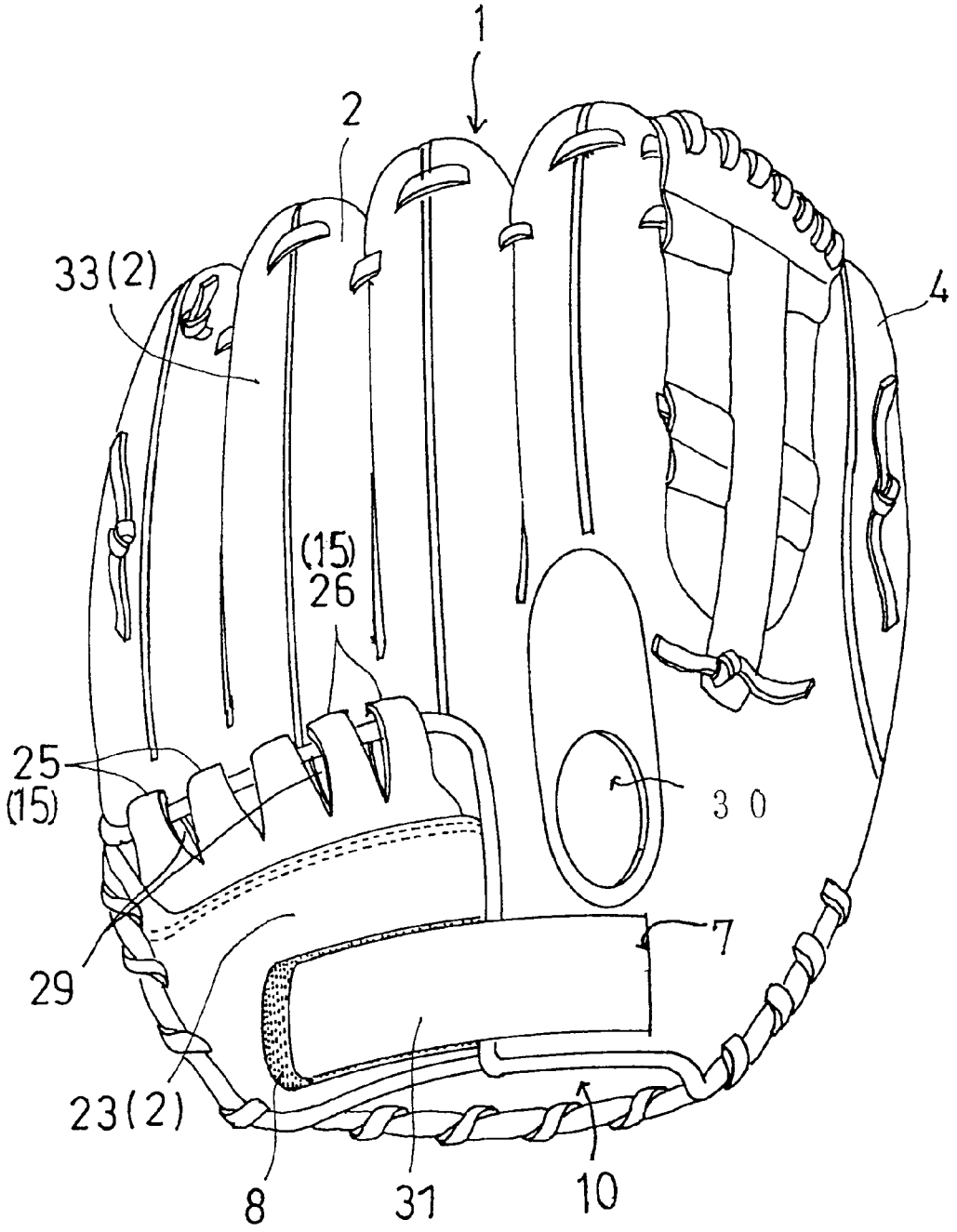
FIG. 5 is a rear view showing a ball catching tool according to a second embodiment.

FIG. 5 shows an enclosing type glove for a baseball according to a second embodiment. The glove is formed such that an outer cover 2 of a glove body 1 covers the back of a hand and an index finger insertion hole 30 penetrates through the outer cover 2.

The glove has such a structure that an outer cover portion 23 on a hand insertion port for receiving and supporting the wrist side of the palm of the hand can be freely fastened to and unfastened from the hand. The outer cover portion 23 on the hand insertion port side is connected to a main outer cover portion 33 on the finger side through flexible means 15, and it is possible to prevent constriction force of the outer cover portion 23 on the hand insertion port side from acting on the main outer cover portion 33 to be curved and deformed with the ball catching operation.

The flexible means 15 is provided with a plurality of through holes 26 formed in a portion connected to the main outer cover portion 33, and is provided with a plurality of band-shaped portions 25 capable of being inserted in each of the through holes 26 and of turning up a loop 29 for connection in a connecting portion of the outer cover portion 23 on the hand insertion port side.

More specifically, the band-shaped portions 25 are individually inserted in the through holes 26 of the main outer cover portion 33. The tip side of each band-shaped portion 25 is turned up and fixed to the back face side. A predetermined portion of the portion connected to the main outer cover portion 33 gently enters the loop 29 formed by the band-shaped portion 25.

The outer cover portion 23 on the hand insertion port side can be freely fastened and unfastened in the following manner. An end of the outer cover potion 23 on the hand insertion port side of the thumb bag portion 4 is separated from the glove body 1, and a through hole 7 for inserting a band member 31 provided on the outer cover portion 23 on the hand insertion port side is formed on the base end side of the thumb bag portion 4 to insert the band member 31 therethrough. In addition, a hook and loop faster 8 for bending, putting and connecting the band member 31 is provided on the outer cover portion 23 on the hand insertion port side and the band member 31.

In the case in which the glove having the above-mentioned structure is to be attached, a hand is inserted from a hand insertion port 10 to the glove body 1 and the outer cover portion 23 on the hand insertion port side is fastened and attached to the palm of the hand. Consequently, it is possible to prevent the glove from slipping off or shifted from the hand during ball catching.

When each finger is bent during the ball catching, the predetermined portion of the outer cover portion 23 on the hand insertion port side is shifted in the longitudinal direction of the hand in the loop 29 formed by the band-shaped portion 25 of the outer cover portion 23 on the hand insertion port side and the main outer cover potion 33 is separated from the outer cover portion 23 on the hand insertion port side which is hard to shift in the longitudinal direction of the hand by the fastening force to the hand and is freely curved with the inner cover 11.

As a result, the inner cover 11 corresponding to the hand palm side of the glove body 1 can tightly bend each finger to catch a ball so as to enclose a ball B.

[THE THIRD EMBODIMENT]

Figure 6:
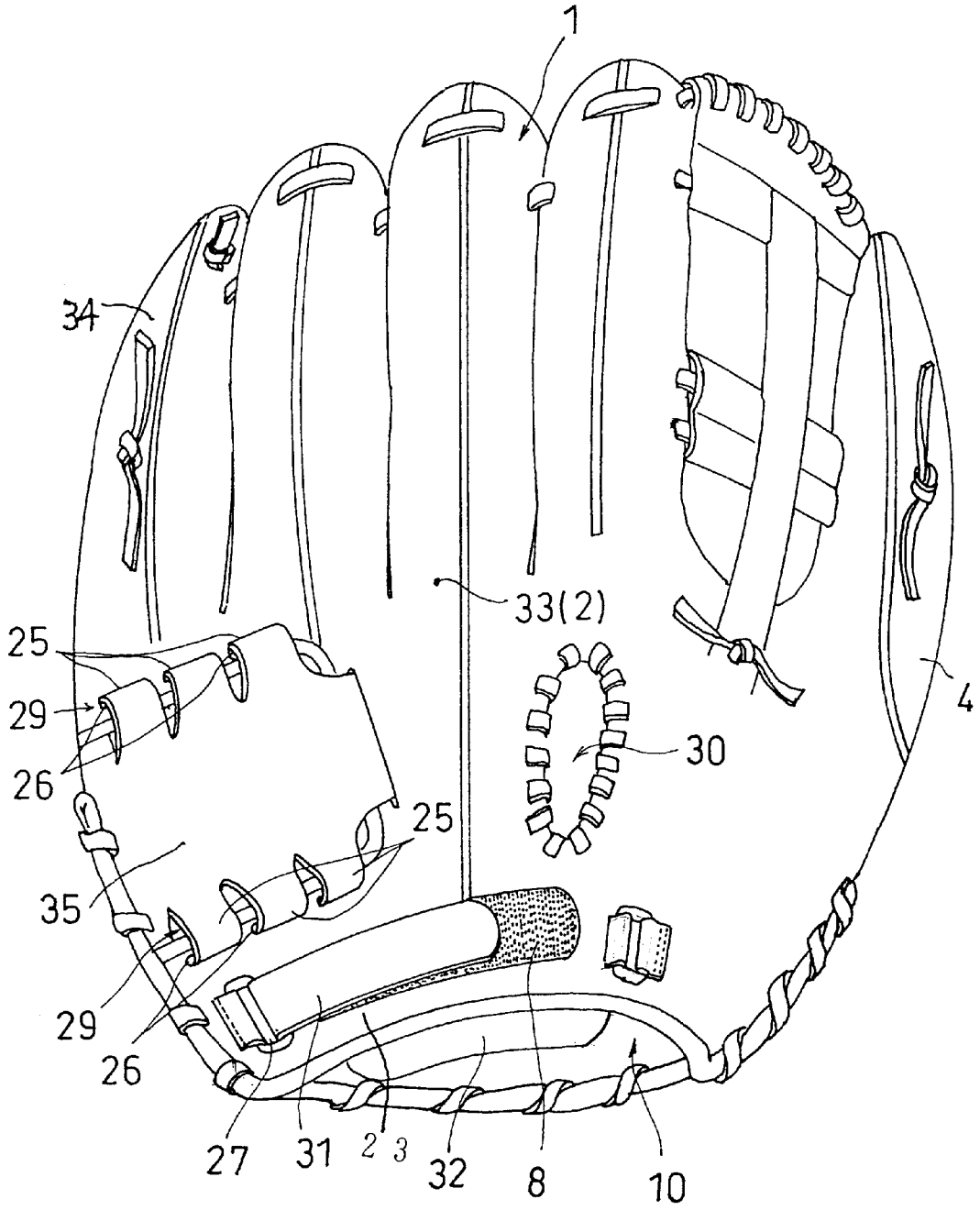
FIG. 6 is a rear view showing a ball catching tool according to a third embodiment.
Figure 7:
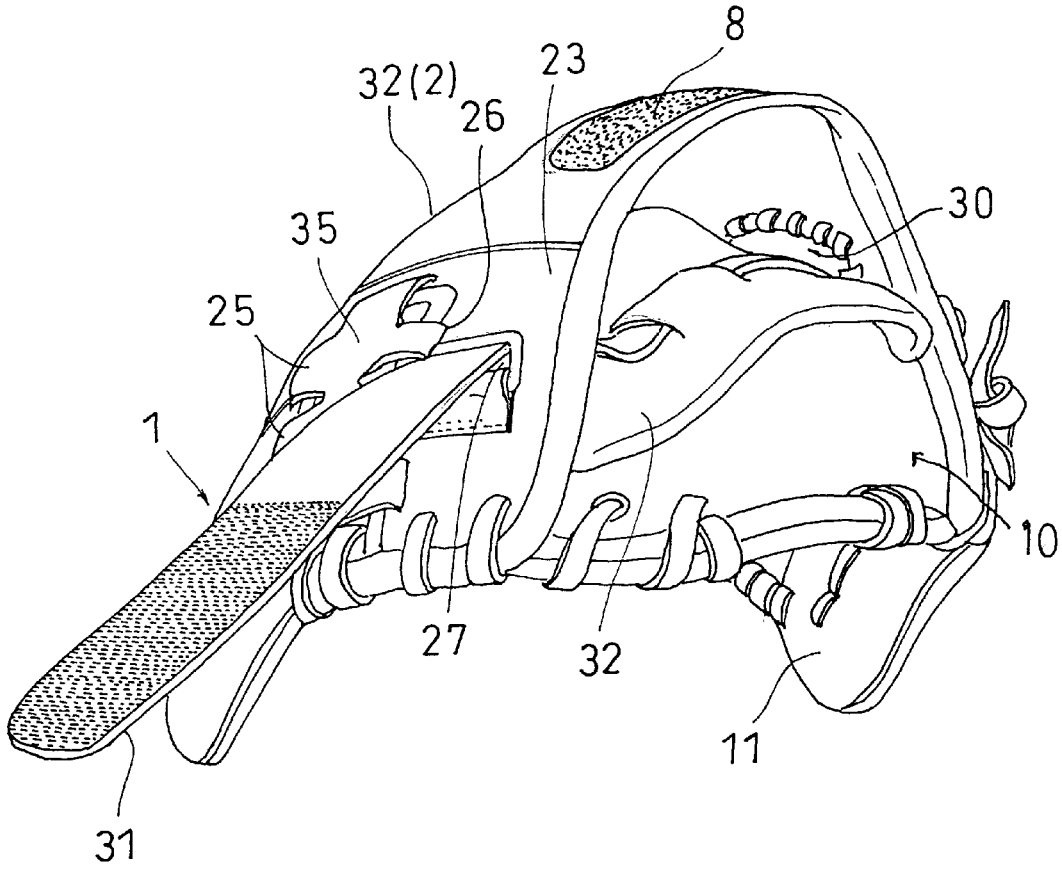
FIG. 7 is a perspective view showing the hand insertion side of the ball catching tool in FIG. 6.

FIG. 6 and FIG. 7 show an enclosing type glove for a baseball according to a third embodiment. The glove has such a structure that an outer cover 2 of a glove body 1 is formed to cover the back of a hand and an index finger insertion hole 30 penetrates through the outer cover 2.

The glove according to the present embodiment has a similar structure to that of the glove according to the second embodiment and a difference will be described.

The outer cover 2 is formed in such a state that a connected portion of a main outer cover portion 33 and a connecting portion of a hand insertion port side outer cover portion 23 are provided apart from each other by a predetermined length and the connected portion of the main outer cover portion 33 is connected to the connecting portion of the hand insertion port side outer cover portion 23 through a connecting member 35.

Flexible means 15 has a plurality of through holes 26 provided on the connected portion side of the main outer cover portion 33 and the connected portion of the hand insertion port side outer cover portion 23, and is provided with a plurality of band-shaped portions 25 capable of individually inserting a loop 29 for connection into the through holes 26 and turning up the loop 29 on the connecting member 35 side.

With such a structure that the hand insertion port side outer cover portion 23 can be fastened and unfastened, one of ends of a band member 31 is fixed to the back side of an outer cover portion on the base end side of a thumb bag portion 4 and the band member 31 is inserted into a through hole 27 formed in the outer cover portion on the base end side of a little finger bag portion 34, a hook and loop fastener 8 for putting and connecting them to each other is provided and a back abutting member 32 for abutting on the back of the hand is supported on the band member 31.

By the above-mentioned structure, each finger can be tightly bent to catch a ball such that an inner cover 11 corresponding to the palm side of the glove body 1 encloses the ball.

[Other Embodiments]

(1) In the first embodiment, the flexible means 15 may have such a structure that a plurality of through holes are formed in the connecting portion of the band 3 and a predetermined number of band-shaped portions capable of individually inserting a loop for connection into the through holes and turning up the loop are provided in the connected portion of the outer cover 2.

(2) In the second embodiment, the flexible means 15 may have such a structure that a plurality of through holes are formed in the connecting portion of the hand insertion port side outer cover portion 23 and a predetermined number of band-shaped portions capable of individually inserting a loop for connection into the through holes and turning up the loop are provided in the connected portion of the main outer cover portion 33.

(3) In the third embodiment, the flexible means 15 may have such a structure that a plurality of through holes are formed on the connecting member 35 side and a plurality of band-shaped portions capable of individually inserting a loop for connection into the through holes and turning up the loop are provided on the connected portion side of the main outer cover portion 23 and in the connected portion of the hand insertion port side outer cover portion 33.

(4) The flexible means 15 is not restricted to the above-mentioned structures but various variants can be employed without departing from the scope of the invention.

(5) The present invention can also be applied to a catcher mitt or a first mitt, and furthermore, can be applied to a glove, a catcher mitt and a first mitt for a softball.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A ball catching tool comprising a ball catching tool body provided with a band in a direction of a hand width for receiving and supporting a back of a hand, the band being capable of being fastened to and unfastened from the hand, wherein the band has such a structure that one of both ends opposite to a thumb bag portion side of the ball catching tool body is connected to an outer cover on a back face side of the ball catching tool body through flexible means and can prevent constriction force of the band from acting on the outer cover to be curved and deformed with a ball catching operation; and the flexible means is constructed with the end of the band to be integral with the band and forms a predetermined number of through holes on one of sides of a connected portion of the outer cover portion and a predetermined number of band-shaped portions capable of individually inserting a loop for connection into the through holes and turning up the loop on the other side.

2. The ball catching tool according to claim 1, wherein a reinforcing member for preventing the through hole from being deformed is provided on the base end side of the thumb bag portion.

3. A ball catching tool comprising a ball catching body having such a structure that an outer cover on a back face side is formed to cover a back of a hand and a hand insertion port side outer cover portion for receiving and supporting a wrist side of the back of the hand can be fastened to and unfastened from the hand, wherein the hand insertion port side outer cover portion is connected to a main outer cover portion on a finger side through flexible means and can prevent constriction force of the hand insertion port side outer cover portion from acting on the main outer cover portion to be curved and deformed with a ball catching operation; and the flexible means forms a predetermined number of through holes on one of sides of a connected portion of the main outer cover portion and a predetermined number of band-shaped portions being integral with the hand insertion port side outer cover portion and capable of individually inserting a loop for connection into the through holes and turning up the loop on the other side.

4. A ball catching tool comprising a ball catching body having such a structure that an outer cover on a back face side is formed to cover a back of a hand and a hand insertion port side outer cover portion for receiving and supporting a wrist side of the back of the hand can be fastened to and unfastened from the hand, wherein the hand insertion port side outer cover portion is connected to a main outer cover portion on a finger side through flexible means and can prevent constriction force of the hand insertion port side outer cover portion from acting on the main outer cover portion to be curved and deformed with a ball catching operation, the outer cover is formed in such a state that the connected portion of the main outer cover portion and a connecting portion of the main outer cover portion and a connecting portion of the hand insertion port side outer cover portion are provided apart from each other by a predetermined length;

the connected portion of the main outer cover portion and the connecting portion of the hand insertion port side outer cover portion are connected to each other through a connecting member;

the flexible means forms a predetermined number of through holes on one of sides of the connected portion of the main outer cover portion and on one of sides of the connected portion of the hand insertion port side outer cover portion and the connecting portion of the connecting member, and a predetermined number of band-shaped portions capable of individually inserting a loop for connection into the through holes and tuning up the loop on the other side.

5. A ball catching tool comprising a ball catching tool body provided with a band in a direction of a hand width for receiving and supporting a back of a hand, the band being capable of being fastened to and unfastened from the hand, wherein the band has such a structure that one of both ends opposite to a thumb bag portion side of the ball catching tool body is connected to an outer cover on a back face side of the ball catching tool body through flexible means and can prevent constriction force of the band from acting on the outer cover to be curved and deformed with a ball catching operation; and the flexible means is constructed with the end of the band to be integral with the band and forms a predetermined number of through holes on one of sides of a connecting portion of said band and a predetermined number of band-shaped portions capable of individually inserting a loop for connection into the through holes and turning up the loop on the other side.

6. The ball catching tool according to claim 5, wherein a reinforcing member for preventing the through hole from being deformed is provided on the base end side of the thumb bag portion.

7. A ball catching tool comprising a ball catching body having such a structure that an outer cover on a back face side is formed to cover a back of a hand and a hand insertion port side outer cover portion for receiving and supporting a wrist side of the back of the hand can be fastened to and unfastened from the hand, wherein the hand insertion port side outer cover portion is connected to a main outer cover portion on a finger side through flexible means and can prevent constriction force of the hand insertion port side outer cover portion from acting on the main outer cover portion to be curved and deformed with a ball catching operation; and the flexible means forms a predetermined number of through holes on one of sides of a connecting portion of a band and a predetermined number of band-shaped portions being integral with the hand insertion port side outer cover portion and capable of individually inserting a loop for connection into the through holes and turning up the loop on the other side.

8. A ball catching tool comprising a ball catching body having such a structure that an outer cover on a back face side is formed to cover a back of a hand and a hand insertion port side outer cover portion for receiving and supporting a wrist side of the back of the hand can be fastened to and unfastened from the hand, wherein the hand insertion port side outer cover portion is connected to a main outer cover portion on a finger side through flexible means and can prevent constriction force of the hand insertion port side outer cover portion from acting on the main outer cover portion to be curved and deformed with a ball catching operation;

the outer cover is formed in such a state that the connected portion of the main outer cover portion and a connecting portion of the main outer cover portion and a connecting portion of the hand insertion port side outer cover portion are provided apart from each other by a predetermined length;

the connected portion of the main outer cover portion and the connecting portion of the hand insertion port side outer cover portion are connected to each other through a connecting member;

the flexible means forms a predetermined number of through holes on one of sides of the connected portion of a band and on one of sides of the connected portion of the hand insertion port side outer cover portion and the connecting portion of the connecting member, and a predetermined number of band-shaped portions capable of individually inserting a loop for connection into the through holes and turning up the loop on the other side.

* * * * *